United States Patent [19]

Görlach et al.

[11] 4,121,484

[45] Oct. 24, 1978

[54] APPLIANCE FOR THE SHARPENING OF THE EDGES OF SKIS

[76] Inventors: Hans Görlach, Lerchenfelstr. 14, D.8950 Kaufbeuren-Neugablonz; Heinz Nolte, D-8939 Jengen,uber Buchloc., both of Germany

[21] Appl. No.: 793,382

[22] Filed: May 3, 1977

[30] Foreign Application Priority Data

May 8, 1976 [DE] Fed. Rep. of Germany ..... 2620504

[51] Int. Cl.[2] ..... B21K 17/00; B23D 67/12

[52] U.S. Cl. ..... 76/83; 280/11.37 T; 29/80

[58] Field of Search ..... 76/83, 88; 7/14.1 R, 7/1 Q; 280/11.37 T; 29/78, 80; 51/205 WG, 214; 30/172, 169

[56] References Cited

U.S. PATENT DOCUMENTS

| | | | |
|---|---|---|---|
| 3,585,880 | 6/1971 | Kabriel | 51/205 WG |
| 3,670,601 | 6/1972 | Weeks | 76/83 |
| 3,875,825 | 4/1975 | Buttafuoco | 76/83 |
| 3,934,287 | 1/1976 | Howard | 7/14.1 R |

*Primary Examiner*—Harold D. Whitehead
*Assistant Examiner*—Roscoe V. Parker
*Attorney, Agent, or Firm*—Holman & Stern

[57] ABSTRACT

An appliance which can be used for sharpening skis, particularly the edges, and if required, for waxing the face of the ski, comprises a body with a flat plate-like main section with a depending extension. These two parts internally house files which can be of like dimension so as to be capable of universal use and readily interchangeable.

6 Claims, 2 Drawing Figures

20
15
17
13
16
7
3
10
18
11
18
8
9
6
2
14
16
1
12
21
21
22

APPLIANCE FOR THE SHARPENING OF THE EDGES OF SKIS

The subject of this invention is an appliance which can be used for sharpening the edges of skis.

The object is to provide an appliance for the above-mentioned purpose which can be easily handled and readily made, and which allows for rapid replacement of the worn parts.

In pursuance of this object the invention provides an appliance for the purpose set forth which comprises a body made up of a part of plate-form which is shaped in conformity with the surface of the hand of a user and an extension adjoining one edge of the plate and extending at a right angle thereto, the inner faces of both the plate and the extension being recessed to accommodate a file and magnetic means to hold this file in position.

This appliance, which for example will advantageously be made of plastics material, provides for an easy and rapid replacement of the files. No hand tools are necessary to fasten the files these being held firmly by the permanent magnets automatically on insertion. There is no danger that they will be inadvertently detached from the appliance.

In practice the outer shape of the appliance caters for a positive guidance thereof in operation and damage is prevented. The outer parameters of the appliance can be small so that it may be carried by the user at all times.

The adaption of the appliance to the hand of the user can be implemented in various ways. In particular the size of the latter will be so chosen as to conform with the dimensions of a normal hand. To obtain optimum contact between the hand and the appliance in accordance with a further feature of the invention troughed depressions are provided in the outer face of the plate part of the appliance in conformity with the contours of the palm of a normal hand.

In accordance with a further expedient in this respect recesses for accommodating the fingers and thumb may be provided. The extension may advantageously be provided at one or both ends with outwardly directed projections. These projections improve the guidance of the appliance by hand and prevent the hand sliding off the extension and for example coming into contact with the sharp edges of the ski.

In a very effective arrangement the plate part and the extension are formed in each case with an elongated recess to house the associated file and with adjoining recesses to accommodate the corresponding magnetic holding means. Advantageously the said elongated recesses are made of the same cross sectional form, which allows for the use of an appliance with one file only, which reduces the production costs.

The advantage of the overlap between the elongated recesses means that the complete running surface of the ski will be engaged by the file right to its over limit. The arrangement also has the attribute that operation with the appliance is simplified because the outer edge and the lower edge or sliding face of the ski can be treated one following the other.

In accordance with a further feature of the invention the elongated recess in the plate part is opposed at an oblique angle to the length of the latter. As a consequence the file will be directed at an acute angle to the surface to be worked, which promotes the effectiveness of the operation.

The magnetic means to hold the files, or the single file, can be of like form. A preferred arrangement lies however in a case where the magnetic means in the plate part are a pair of circular magnets and, in the case of the extension a bar magnet.

The appliance according to the present invention, in addition to being used for machining the edges and the wear face of the ski can also be used for waxing purposes. For this reason the plate may be provided at its leading edge with a flange forming a wax smoothing part. This edge will conveniently extend at an oblique angle to the plate part. The file or files will of course be removed when waxing takes place.

An embodiment of the invention is illustrated diagrammatically in the accompanying drawings, in which.

Figure 1:
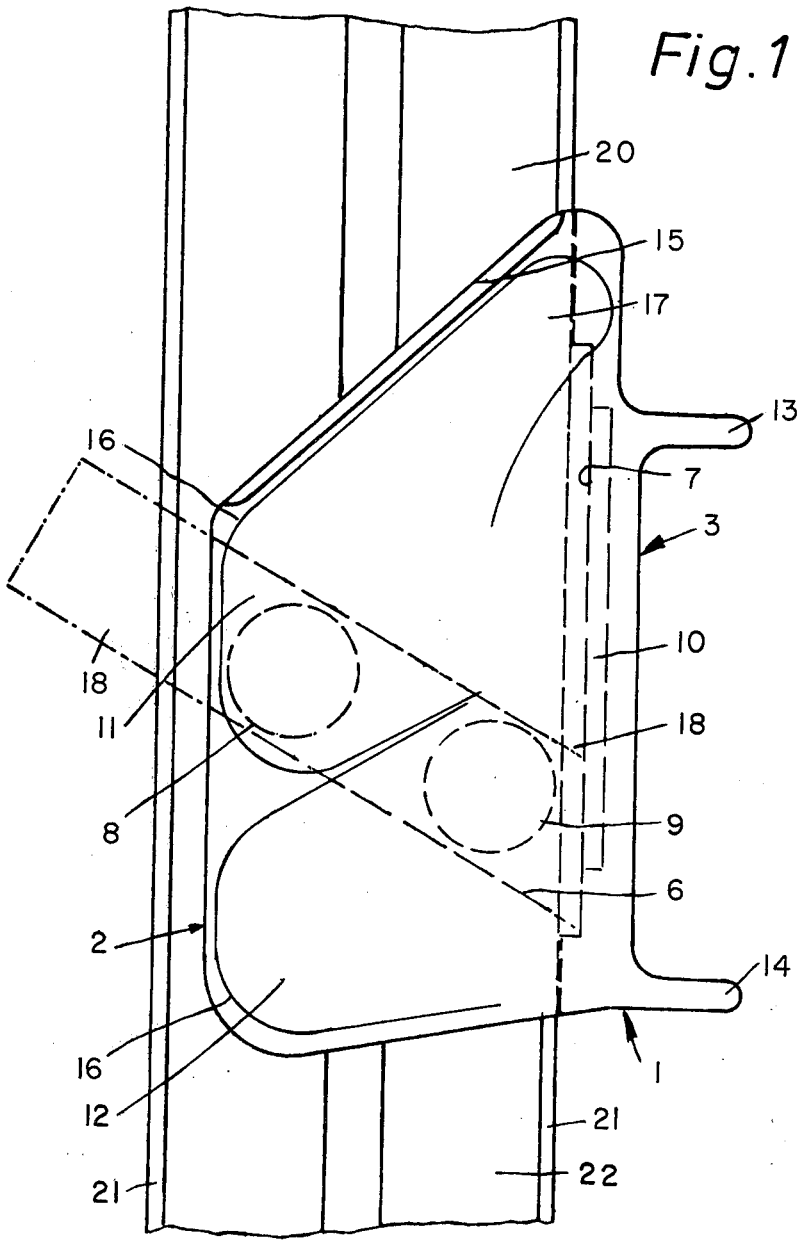
FIG. 1 is a plan view of the appliance shown in use on a ski blade.

The appliance 1 primarily comprises a part 2 of plate form with an extension 3 which is substantially of L-shape in cross section. The plate part 2 has troughed depressions 11 and 12 at its outer face to assist handling. The lines 16 indicate the layout of these depressions. An opening can be provided in the area 17 to take the thumb of the user. In use the outer surface of the plate part is grasped in the palm of the hand with the fingers disposed between projections 13 and 14 on the extension 3.

The plate part 2 has a wax smoothing edge 15 which is formed by turning down the plate sharply at this part. The plate can be of rectangular form, but it is preferred to provide the wax smoothing edge at an oblique angle, as shown. This helps compression and distribution of the wax.

A recess 6 is provided in the plate part 2 and a recess 7 in the extension 3. The contours of the two recesses substantially conform with one another, particularly as regards depth.

Figure 2:
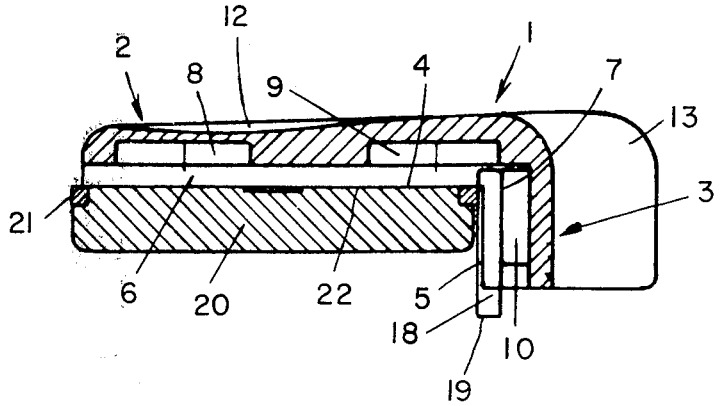
FIG. 2 is a section through the arrangement illustrated in FIG. 1 taken on the line II—II.

As shown in FIG. 2 recess 7 accommodates a sharpening file 18. The extension 3 can be made of a form enabling it to embrace the lower edge 19 of the file. The extension 3 has in the vicinity of recess 7 a recess for a bar magnet 10. Arranged in the plate part 2 are circular magnets 8 and 9 which hold the file in position in recess 6.

Care must be taken that the recess in the inner surface 4 reaches somewhat further than the inner surface 5 of the extension 3, and recess 7 is designed so that the file 19 can readily reach the edges of the ski 20 which at any time are to be machined.

As previously mentioned not only can the edge 21, for example metallic, be treated by the appliance, but at the same time the wear face 22 of the ski can be smoothed.

We claim:

1. An appliance for sharpening the longitudinal edges of skis, wherein said edges are comprised essentially of a right angle connecting the bottom of the ski to the side of the ski, said appliance comprising, a body made up of a part of plate-form which is shaped in conformity with the surface of the hand of a user and having a major surface extending parallel to the bottom of the ski and a minor surface extending at right angles to the major surface and essentially parallel to the side of the ski, the improvement comprising:

first recess means for defining a recess in said major surface for retaining a file therein and preventing movement of said file relative to said body in the longitudinal direction with respect to said edges;

second recess means for defining a recess in said minor surface for retaining a file therein and preventing movement of said file relative to said body in the longitudinal direction of said edges;

a first file disposed in said first recess means;

a second file disposed in said second recess means;

magnetic retention means, recessed in each of said recess means, for removably retaining said files therein; and said recess means having a depth less than a thickness of said files such that said files protrude above said major and minor surfaces, said recesses and files arranged such that said first file projects at least to said minor surface and said second file projects at least to said major surface, forming an angle corresponding to said right angle of said edges.

2. An appliance according to claim 1, in which the magnetic retention means in the first recess means are a pair of circular magnets and, in the case of the second recess means, a bar magnet.

3. An appliance according to claim 1, in which the outer face of the plate part is formed with troughed depressions conforming with the superficial contours of the palm of the hand.

4. An appliance according to claim 1, in which said minor surface is provided at one side at least with a pair of longitudinally spaced outward projections defining a cavity for reception of the fingers of the hand of a user grasping the appliance.

5. An appliance according to claim 1, in which the plate is provided at its leading edge with a flange forming a wax smoothing part.

6. An appliance according to claim 5, in which said wax smoothing edge extends at an oblique angle to the plate part.

* * * * *